US010107548B2

(12) United States Patent
Mize et al.

(10) Patent No.: US 10,107,548 B2
(45) Date of Patent: Oct. 23, 2018

(54) HEAT TRANSFER DEVICE

(71) Applicants: William Pleasants Mize, Brandon, MS (US); Allen Hobbs Mize, Biloxi, MS (US)

(72) Inventors: William Pleasants Mize, Brandon, MS (US); Allen Hobbs Mize, Biloxi, MS (US)

( * ) Notice: Subject to any disclaimer, the term of this patent is extended or adjusted under 35 U.S.C. 154(b) by 85 days.

(21) Appl. No.: 15/272,472

(22) Filed: Sep. 22, 2016

(65) Prior Publication Data

US 2018/0080706 A1 Mar. 22, 2018

(51) Int. Cl.
*F25D 31/00* (2006.01)
*F25D 1/02* (2006.01)
*F25D 17/02* (2006.01)

(52) U.S. Cl.
CPC ..... *F25D 31/007* (2013.01); *F25D 1/02* (2013.01); *F25D 17/02* (2013.01); *F25D 2201/10* (2013.01)

(58) Field of Classification Search
CPC ..... F25D 31/007; F25D 2331/803; F25D 2331/805; F25D 2400/28
See application file for complete search history.

(56) References Cited

U.S. PATENT DOCUMENTS 2,622,852 A 12/1952 Skrzycki
3,995,445 A 12/1976 Huskins
4,024,903 A 5/1977 Yf'maqa
5,636,522 A 6/1997 Ramos
5,709,104 A 1/1998 Howcroft
6,035,660 A 3/2000 Craft
6,336,341 B1 1/2002 McGrawm
6,571,568 B1 6/2003 Link
7,140,507 B2 11/2006 Maldonado
7,269,969 B2 9/2007 Strickland
(Continued)

*Primary Examiner* — Cassey D Bauer
(74) *Attorney, Agent, or Firm* — William C. West

(57) ABSTRACT

A heat transfer device is presented and more particularly a beverage cooling assembly comprising: one or more container holders with each having a first and a second wall with a chamber therebetween, the chamber having an inlet and an outlet and otherwise sealed, through which a circulating fluid is pumped from a reservoir, such as an ice chest; a reservoir adapter attached to the drain outlet of the ice chest and to a supply line, or a pump that is attached to the supply line that is attached to the inlet of the one or more containers, the first wall and a second wall forming a double-walled cylinder with a pocket for a beverage container. The circulating fluid is returned from the outlet of one or more container holders through a return line to the reservoir adapter and then connected to a long line placed through the reservoir adapter and then through the drain outlet of the ice chest, returning the circulating fluid to the reservoir away from the drain outlet. The first wall forms an inner cylindrical wall that is adjacent to the beverage container and is formed of a material having a low thermal resistance. The second wall forms an outer wall of the chamber surrounding the first wall is made is made of a material having a high thermal resistance and may be surrounded by an insulation layer. Distribution guides may be placed in the chamber to more effectively distribute the circulating fluid for effective heat transfer.

21 Claims, 19 Drawing Sheets

(56) References Cited

U.S. PATENT DOCUMENTS

| | | | | |
|---|---|---|---|---|
| 2002/0007637 | A1* | 1/2002 | Simmons | F25B 9/14 62/6 |
| 2006/0053828 | A1 | 3/2006 | Shallman | |
| 2011/0030413 | A1 | 2/2011 | Heil | |
| 2011/0277485 | A1* | 11/2011 | Yang | F25B 21/02 62/3.2 |
| 2014/0069112 | A1 | 3/2014 | Park | |
| 2014/0103129 | A1 | 4/2014 | Ray | |
| 2014/0130517 | A1 | 5/2014 | Oh | |
| 2014/0338366 | A1 | 11/2014 | Adldinger | |
| 2016/0091244 | A1* | 3/2016 | Revelis | F25D 31/007 62/457.9 |

* cited by examiner

HEAT TRANSFER DEVICE

CROSS-REFERENCE TO RELATED APPLICATIONS

NONE

BACKGROUND OF THE INVENTION

1. Field of the Invention

The present invention relates to heat transfer devices and more particularly to a beverage cooler assembly for one or more individual beverage containers. The beverage cooling assembly has a container holder having an internal chamber through which a fluid is circulated and used to exchange heat with a container placed in the container holder. The fluid is supplied from and returned to a reservoir using supply and return lines that may be configured with a reservoir adapter attached to the drain outlet of the reservoir.

2. Description of Related Art

The present invention relates to a heat transfer device, a beverage cooling assembly, and in particular a means of cooling a beverage using a readily available reservoir, such has the fluid in an ice chest or a pond of water. People attending recreational activities (e.g., baseball games, football games, a day at the beach, swimming at a local pool, etc.) often bring beverages in an ice chest to consume while participating in the event. Once removed from the ice chest, the temperature of the beverage tends toward the temperature of the environment. On warm days and nights, beverages are best severed when cool and once warn become undesirable to consume. Many prior art devices may use variety of thermoelectric devices to heat and warm beverage containers and/or use a system of coils and tubes wrapped around the beverage or a container holder to maintain the desired temperature. These systems are costly to produce and maintain, and fail to take advantage of a readily available cooling reservoir often available during these recreational activities from which a cooled fluid can be obtained and used to maintain beverages once removed from the cooler.

A primary object of the present invention is to provide a beverage cooling system for use during recreation activities to cool a beverage container using an available fluid reservoir, such as ice chest or coolers with ice. These items are often carried to picnics, sporting events, and other recreational activities. Additionally, boating activities on rivers, lakes and coastal waters provides a readily available source of water that us cooler than the surrounding air temperature.

Another object of the present invention is to provide beverage cooling system that is easy to assemble and maintain. Many beverage cooling system require special equipment to purge the cooling chamber. The current invention is easy to set up by attaching the circulator to a fluid source and pumping the fluid to the cooling chamber and through a supply line and returning the fluid to the reservoir through the return lines to the reservoir. The component can be easily disconnected and the system purged with a cleaning agent.

Still another object of the present invention is to provide beverage cooling system that is easy to manufacture at a minimal costs. Many beverage cooling system require expensive thermo electric devices, sophisticated closed loop heat exchangers. The present invention has simple dual wall fluid heat exchanger and is an open loop heat exchanger that may use readily available fluid sources such as water from an ice chest, a pond, a lake, a river, or coastal water.

Yet another object of the present invention is to provide beverage cooling system that is efficient to use and clean. The present invention provides a cooling means for beverage containers, efficiently using available reservoirs of water as previously discussed. The supply and return lines of the present invention can be easily attached and removed and the chamber emptied of the circulating fluid.

Still yet another object of the present invention is to provide a cooling chamber that can easily be divided into compartments using one or more distribution guides that effect the efficient transfer of heat from the beverage containers to the circulating coolant. Various embodiments of the present invention may have different distribution guides to divide the chamber in segments or have fins wrapped around the inner wall to more effectively transfer heat to the circulating fluid.

A still further object of the present invention to provide a cooling means for beverage containers that efficiently circulates a cooling fluid to achieve the desired temperature. The present invention requires a simple pump to effectively circulate fluid from a readily available reservoir and the exterior chamber wall may be made of materials that minimize the transfer of heat from the environment surrounding the container holder.

Other objects of this invention will appear or become apparent in the following description, appended claims, and the accompanying drawings forming a part of this specification. It should be noted that like reference characters designate corresponding parts in the different views.

BRIEF SUMMARY

The heat transfer device presented is a beverage cooler assembly for one or more individual beverage containers. The beverage cooler assembly that may comprise: one or more container holders, a circulator, a reservoir, a reservoir adapter, and one or more supply and return lines. Each of the container holders has a chamber between a first and a second wall. The container holder has a pocket formed by the first wall, the pocket sized to hold a beverage container desired to be cooled. The circulator, such has a pump, circulates a fluid, such as cold water from a reservoir through a supply line and then through the chamber of the container holder and then through a return line to the reservoir where the fluid is conditioned by mixing with the colder fluid in the reservoir. The reservoir may be an ice chest with ice water, a lake, a river, and a pond. Where at least two container holders are used, the container holders may be connected in series by one or more transfer lines to transfer the fluid from a container holder in a series to the next numbered container holder in the series and so on with the last container holder in the series is connected to the return line that returns the fluid to the reservoir.

Alternatively, where there is more than one container holder, the supply line may be connected to a supply manifold and the supply manifold connected to an inlet of each chamber of the each container holder, and an outlet of the chamber of the each container holder may be connected to a return manifold with the return manifold connected to the return line. The one or more container holders exchange heat from the containers placed in the one ore more container holders transferring the heat to the fluid flow flowing in the chamber of the each container holder. The reservoir adapter may be sized and configured to mount on the drain outlet of particular types of ice chest. This may be including threaded and non threaded drain outlets. The reservoir adaptor may also be sized and configured to connect to the supply line, and the drain outlet of the intended reservoir, allowing fluid from the reservoir to flow through a supply input port through a supply output port to the supply line. The reservoir adapter may further be adapted to accept the return line through a return in port and then route the return line through the reservoir adapter and then though the drain outlet into the reservoir, or a long line may be connected to the return line at the return input port, with the long line passing through the drain outlet and the long line disposed away from the drain outlet to reduce mixing of the fluid flow in the long line with the fluid flow currently entering the reservoir adapter from the reservoir. The long line may have perforated and non-perforated portions with the perorated portion further away from the drain outlet. The perforated portion may have one or more line ports for the return fluid flow and may be made of a material with a low thermal resistance allowing heat to be dissipated along a length of the perforated portion. Additionally, the perforated portion may be generally rigid allowing the long line to be easily inserted through the drain outlet into the reservoir without kinking or being crushed by objects in the reservoir. The perforated portion may also have end cap to facilitate pushing the long line though and around the objects in the reservoir. The end cap may have one or more end ports to allow release of the fluid flow from the return line to the reservoir.

An embodiment of the container holder without distribution guides, a guideless container holder, has all the elements of the container holder previously discussed. Other embodiments of the container holder may have one or more distribution guides between the first wall and the second wall of the each container holders. Another embodiment of the container holder, the inlet-outlet distribution guide container holder has all the characteristic of the guideless container holder plus a first distribution guide. The first distribution may divide the chamber in symmetric portions, such as a first half and a second half, splitting the inlet low between each of the halves. Yet another embodiment, inlet-outlet triangular distribution guide container holder uses a second distribution guide that is triangular shaped to more easily divide the fluid flow at the inlet. Still yet another embodiment of the container holder, a partial wall container holder uses a third distribution guide. The third distribution guide may be disposed with a guide second end below a top cap on the chamber, the guide second end being a top edge of the third distribution guide and disposed below the second wall edge of the second wall and below the first wall edge of the first wall providing a partial wall across the chamber. The third distribution guide divides the chamber in halves with the outlet disposed generally directly opposite the inlet on the second wall and the third distribution guide located midway between the inlet and the outlet with the inlet and the outlet on an generally opposite each other on an end of the chamber without the first wall edge. The fluid flows from the inlet circulating through the one half of the chamber up the first wall and over the guide second end that is near the top cap, and then down the first wall and then through the outlet. Yet still yet another embodiment of the container holder, a combination distribution guide container holder, may have the first distribution guide and the third distribution effectively dividing the chamber into quarters distributing the fluid flow of coolant. Yet still yet another embodiment of the container holder, a spiral distribution guide container holder, may also be used in the beverage cooler assembly. The spiral distribution guide container holder may have a spiral distribution guide wrapped around the first wall inner surface and disposed between the first wall and the second wall channeling the fluid flow around the inner wall in a spiral fashion similar to the threads on a pipe or blade of an auger. Still yet another embodiment of the container holder, a fin distribution guide container holder, may also be used in the beverage cooler assembly. The fin distribution guide container holder may have one or more fin distribution guides, each fin distribution guide mounted in the chamber vertically in a radial manner around the first wall inner surface of the first inner wall of the chamber channeling the fluid flow across each of the one or more fin distribution guides as the fluid flow goes from the inlet to the outlet.

All embodiments of the container holder may further comprise an insulation layer with the insulation layer being adjacent to a second wall outer surface of the second wall limiting transfer of heat from the environment to the container. Additionally, the inlet and outlet may be generally located on opposite sides of the second wall of the container holder. The inlet and outlet are adapted for connection to an inlet connector and an outlet connector, respectively, that are connected to supply and return (or transfer) lines, respectively, or in the alternative, to a supply and a return manifolds, respectively, to supply and return, respectively, the circulating fluid (e.g., water) to the reservoir.

The appended drawings are not necessarily to scale and the simplified illustrations are depicted to present the present invention and the principles of employment. Specific dimensions, orientations, locations, and shapes are for illustration purposes, and final dimensions and item parameters will be determined in part by the particular intended application and use environment. The terms cooling, cool and ice water are interchangeable with the words heating, heat, and heated fluid, respectively based on the intended application and use in the environment. In the figures, reference numbers refer to the same or equivalent parts of the present invention.

DESCRIPTION OF THE INVENTION

Figure 1:
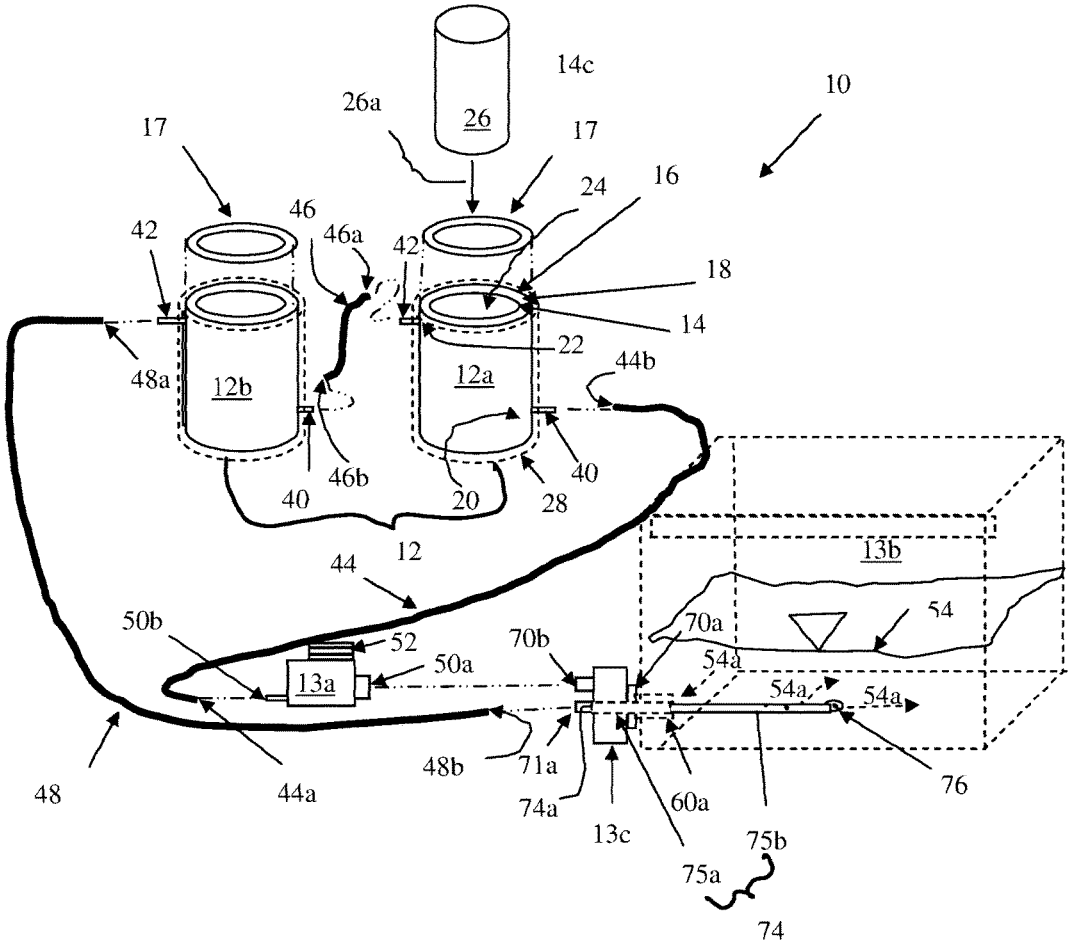
FIG. 1 is a prospective view of the present invention.
Figure 2:
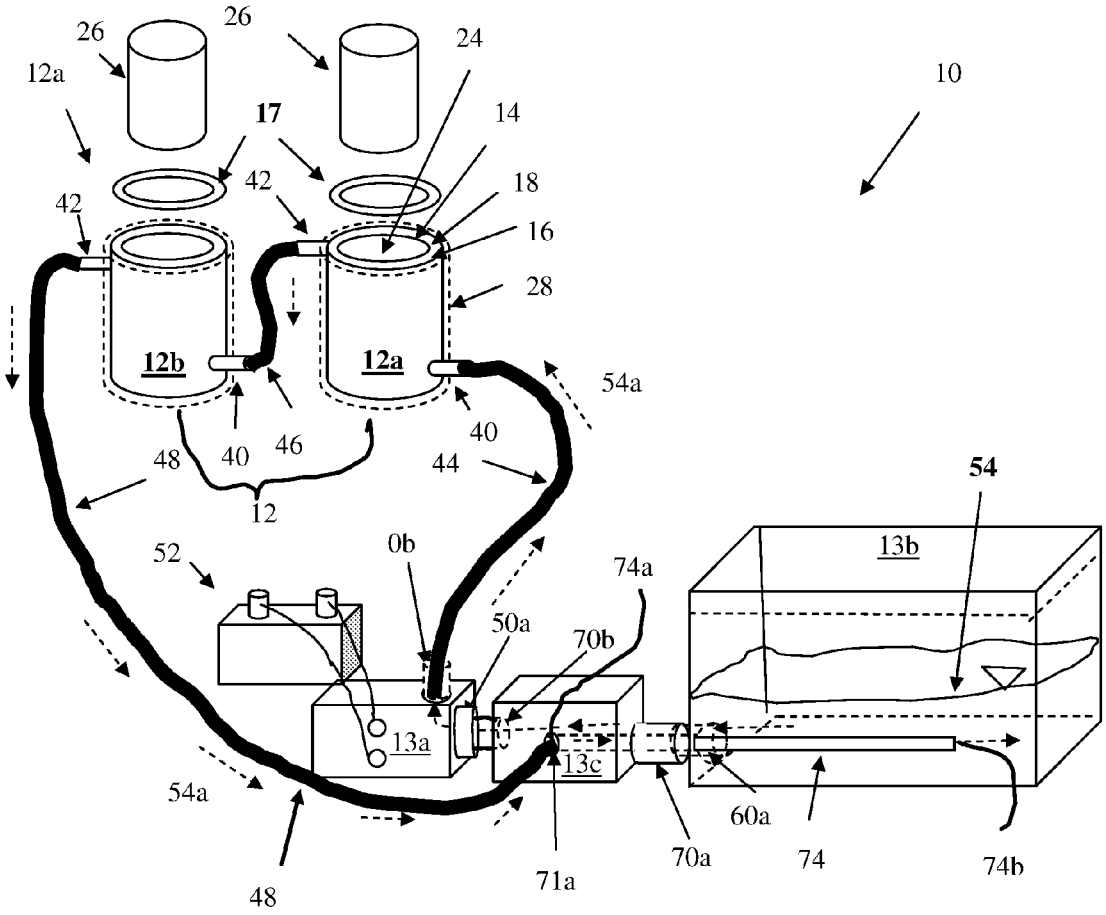
FIG. 2 is another prospective view of the present invention.

Referring to FIG. 1 and FIG. 2, a heat transfer device, a beverage cooler assembly 10, is illustrated. The beverage cooler assembly 10 comprises one or more container holders 12, such as a first container holder 12*a* and a second container holder 12*b*. The beverage cooler assembly 10 may also comprise a circulator 13*a* to circulate a coolant through the each of the one or more container holders 12 transferring heat to the coolant. The beverage cooler assembly 10 may further comprise a reservoir adapter 13*c*. The reservoir adapter 13*c* allows the coolant to be accessed from a reservoir 13*b*. The reservoir adapter 13*c* is integrated with the circulator 13*a*, such has a pump, to circulate the coolant through the one or more container holders 12 from the reservoir 13*b*, such as an ice chest.

Figure 3:
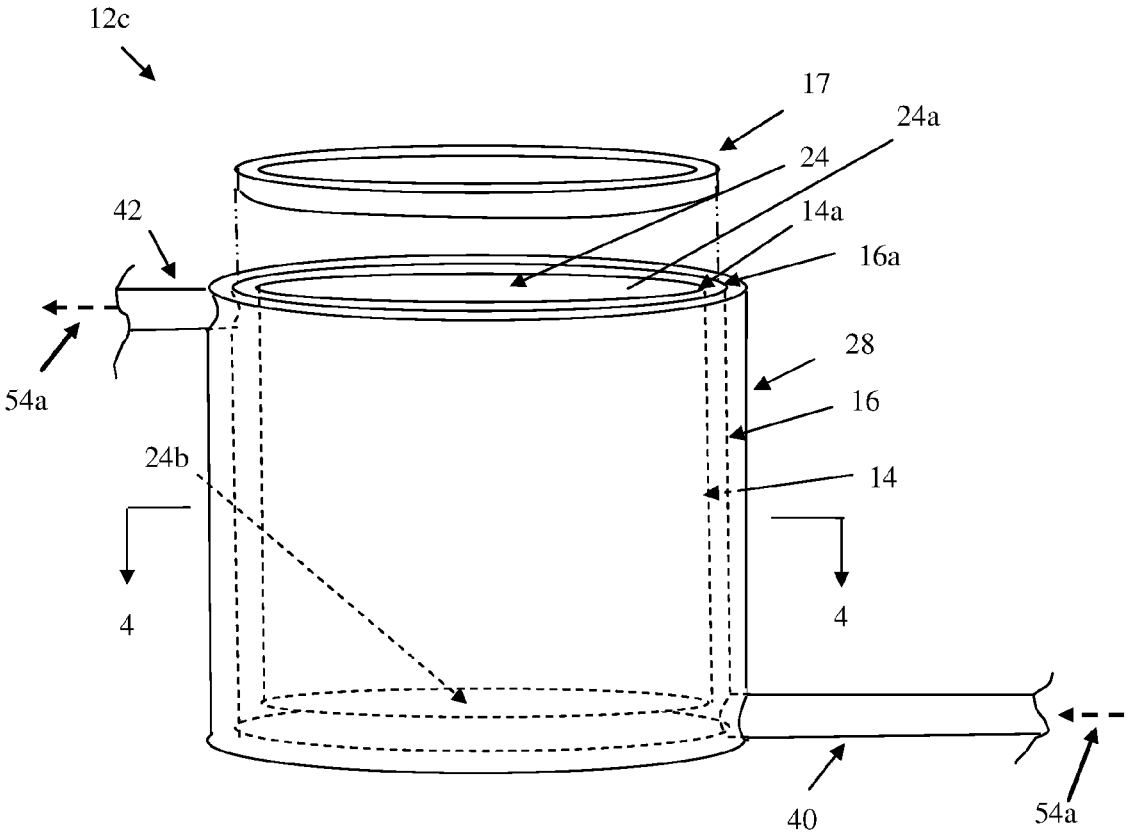
FIG. 3 is a prospective view of a guideless container holder of the present invention.
Figure 4:
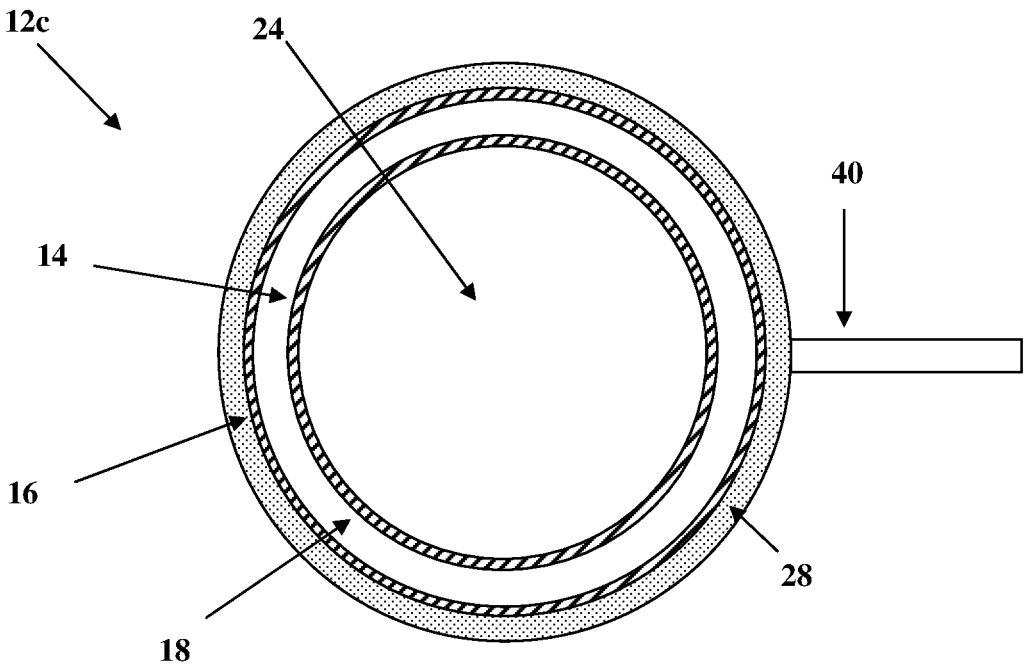
FIG. 4 is a sectional view along line 4-4 of FIG. 3.
Figure 5:
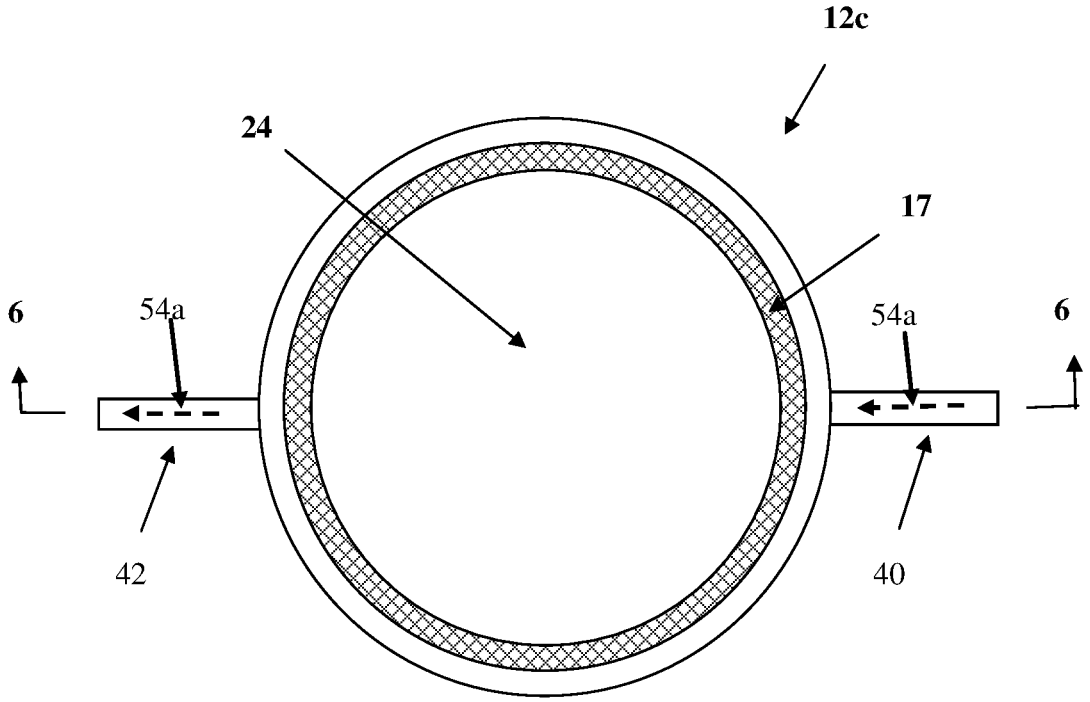
FIG. 5 is a top view of a guideless container holder of the present invention.

Referring to FIG. 3, a prospective view of one embodiment of a container holder 12, the guideless container holder 12*c*, is shown with a sectional view of the guideless container holder 12*c* of FIG. 3 shown in FIG. 4. A top view of the guideless container holder 12*c* is shown in FIG. 5 with sectional view of FIG. 5 shown in FIG. 6.

Figure 6:
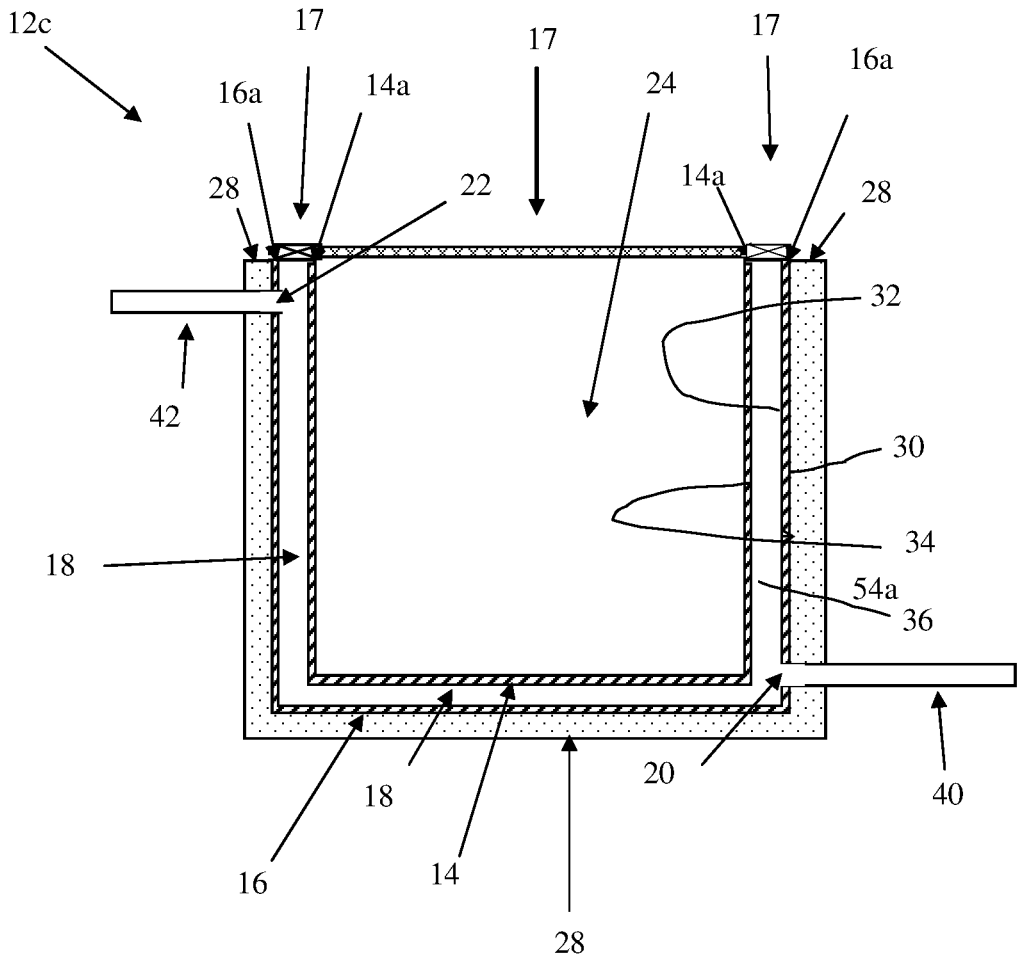
FIG. 6 is a sectional view along line 6-6 of FIG. 5.

Looking to FIG. 6, the guideless container holder 12*c* has a first wall 14 and a second wall 16 having a first wall edge 14*a* and a second wall edge 16*a*, respectively, with the second wall 16 disposed outside the first wall 14. A chamber 18 is located between the first wall 14 and the second wall 16. The chamber 18 may be sealed at the first wall edge 14*a* and a second wall edge 16*a* by a top cap 17 covering the first wall edge 14*a* and the second wall edge 16*a*, or in one alternative (not shown), the second wall edge 16*a* disposed sealed against the first wall 14, or in a second alternative (not shown), the second wall edge 16*a* joined to the first wall edge 14*a*, or in a third alternative (not shown), the first wall edge 14*a* folded and sealed to the second wall 16. The top cap 17 may be a donut shaped structure welded or attached with an adhesive to the first wall edge 14*a* and the second wall edge 16*a*. Referring to FIGS. 3, 4 and 6, the second wall 16 has an inlet 20 and an outlet 22 and the second wall 16 encloses the first wall 14.

Figure 7:
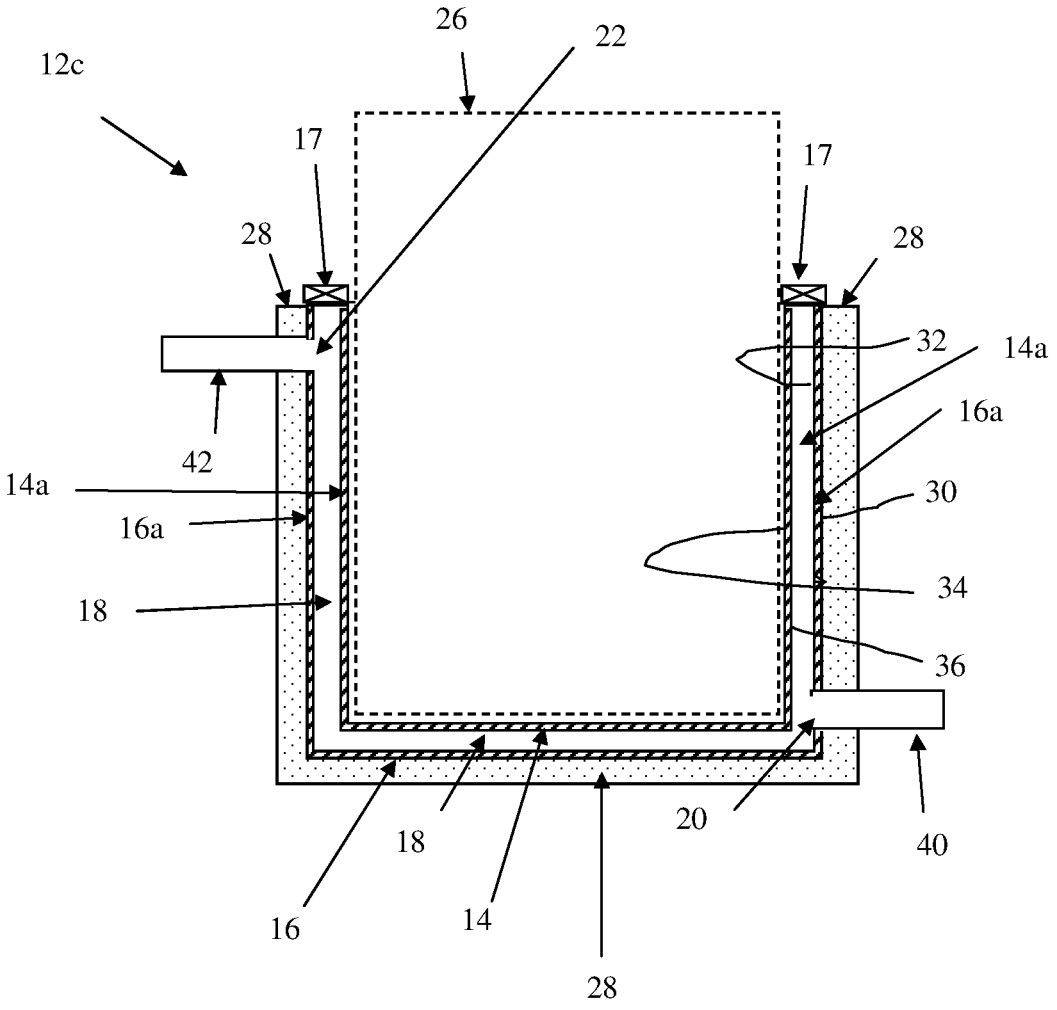
FIG. 7 is a view of FIG. 6 with a container placed in the guideless container holder.

Referring to FIGS. 1, 3 and 7, the first wall 14 is disposed to have a recess (i.e., a pocket 24) sized to hold a container 26 inserted in insert direction 26*a* in the pocket 24. Looking to FIG. 3, the pocket 24 has a top opening 24*a* formed by the first wall edge 14*a* and a pocket bottom 24*b* formed a portion of the first wall outer surface 34 of the first wall 14. Looking to FIG. 6, the second wall 16 has a second wall outer surface 30 and a second wall inner surface 32, and the first wall 14 has a first wall outer surface 34 and a first wall inner surface 36. The one or more embodiments of the container holder 12, such as the guideless container holder 12*c*, may further comprise an insulation layer 28 with the insulation layer 28 being adjacent to the second wall outer surface 30 of the second wall 16.

The inlet 20 connects to an inlet connector 40 and the outlet 22 connects to an outlet connector 42. The inlet connector 40 and the outlet connector 42 extend from the second wall outer surface 30 of the second wall 16. Referring to FIGS. 1 and 2, the inlet connector 40 is connected to a supply line 44 and the outlet connector 42 connected to a transfer line 46 when there is a second container holder 12*b*, or a return line 48 when only the first container holder 12*a* of the one or more container holders 12 is in the beverage cooler assembly 10. The second container holder 12*b* may be generally equivalent to the first container holder 12*a*.

The supply line 44 has a first end 44*a* and a second end 44*b*; the transfer line 46 has a first trans opening 46*a* and a second trans opening 46*b*; and the return line 48 has a first opening 48*a* and a second opening 48*b*. The second end 44*b* of the supply line 44 is connected to the inlet connector 40 and the first opening 48*a* of return line connected to the outlet connector 42 of the second container holder 12*b*, and the first trans opening 46*a* is connected to the outlet connector 42 of a first container holder 12*a* of the one or more container holders 12; and the second trans opening 46*b* connected to the inlet connector 40 of the second container holder 12*b*.

The circulator 13*a* is connected at a circulator out-port 50*b* to the first end 44*a* of the supply line 44 and circulates a fluid 54 from a reservoir 13*b* along a fluid flow 54*a* through the supply line 44, through the first container holder 12*a*, then through the transfer line 46, then through the second container holder 12*b*, and through the return line 48 to the reservoir 13*b*; and in an alternative, the circulator 13*a* circulates the fluid 54 from the reservoir 13*b* through the return line 48, through the second container holder 12*b*, through the transfer line 46; the first container holder 12*a*, through the supply line 44, through the circulator 13*a* and then through the reservoir adapter 13*c* to the reservoir 13*b*.

Referring to FIGS. 1 and 2, the reservoir adapter 13*c* has a supply in-port 70*a*, a supply out-port 70*b*, and a return in-port 71*a*. The return in-port 71*a* connects to a return end 74*a* of a long line 74 with the second opening 48*b* of the return line 48. The long line 74 runs into the reservoir 13*b* far enough to allow the fluid 54 in the fluid flow 54*a* to be dispersed into the reservoir 13*b* away from a reservoir drain outlet 60*a*. The supply in-port 70*a* is connected to the reservoir drain outlet 60*a* and the supply out-port 70*b* is connected to the circulator in-port 50*a*, and a circulator out-port 50*b* is connected to the first end 44*a* of the supply line 44 enabling the circulator 13*a* to pump the fluid 54 from the reservoir 13*b*.

Figure 2A:
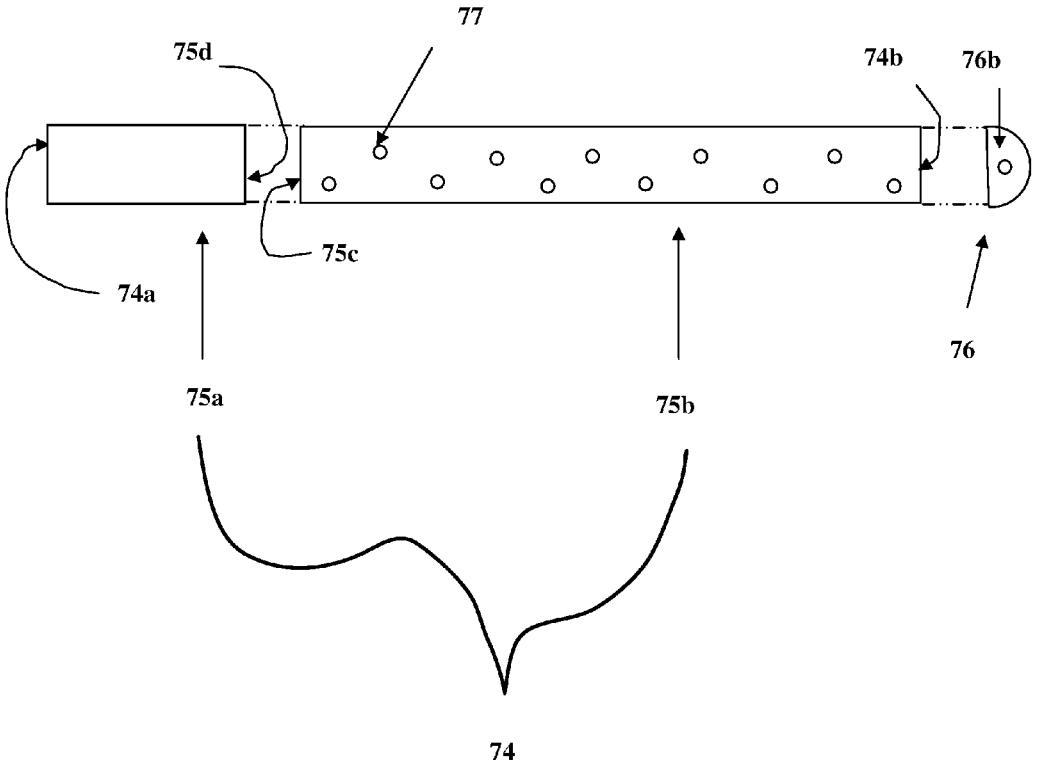
FIG. 2A is a side view of a long line of the present invention.

Looking to FIGS. 1, 2, and 2A, the long line 74 has reservoir end 74*b* with the reservoir end 74*b* disposed in the reservoir 13*b*. The long line 74 may have a non-perforated portion 75*a* and a perforated portion 75*b*, and the perorated portion 75*b* may be made of a thermally conductive material with a low thermal resistance, such as a copper, a steel (e.g. stainless steel), or an aluminum alloy.

Referring again to FIG. 1 and more particularly to FIG. 2A, the long line 74 may have an end cap 76 attached, or be without an end cap 76 as shown in FIG. 2. Looking to FIG. 2A, the reservoir end 74*b* of the perforated portion 75*b* is capped with the end cap 76. The perforated portion 75*b* has an initial end 75*c* that is located opposite the reservoir end 74*b*, and the initial end 75*c* is connected to an outgoing end 75*d* of the non-perforated portion 75*a*. The end cap 76 may have at least one end port 76*b* and the perforated portion 75*b* may have has at least one line port 77. The end cap 76 may be hemispherical to enhance shoving the long line 74 through ice or other objects in the ice chest. The circulator

13*a* is powered by a power source 52. The power source 52 may be a battery, a generator, or an electrical outlet.

Referring to FIGS. 1 and 2, when the reservoir 13*b* is an ice chest, to return the fluid flow 54*a* to the reservoir 13*b*, the return line 48 may placed directly in the reservoir 13*b* by placing the return line 48 under (not shown) the lid of the ice chest, inserting the return line 48 through a new port (not shown) drilled in the ice chest or alternatively, the return line 48 may be connected to the long line 74 and the long line 74 placed through the reservoir drain outlet 60*a* into the reservoir 13*b*.

Figure 8:
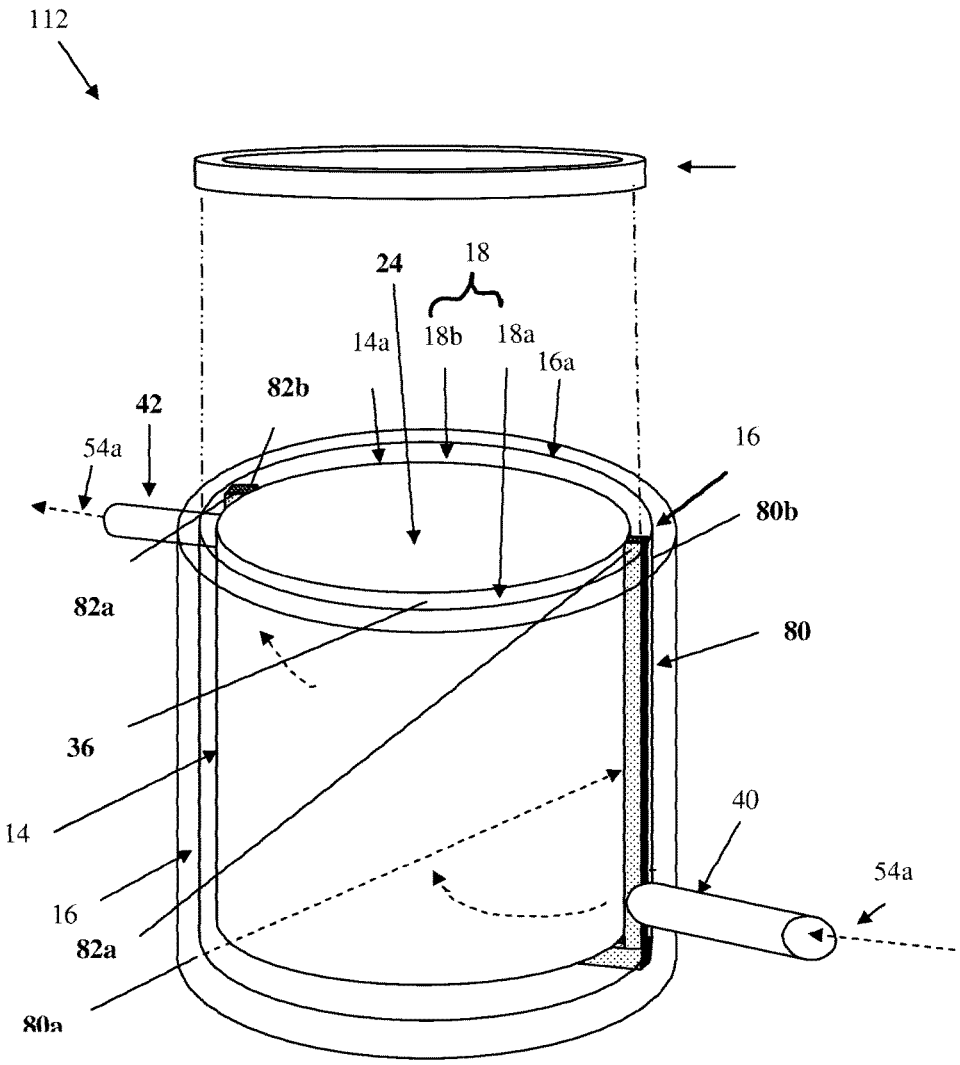
FIG. 8 is a prospective view an inlet-outlet distribution guide container holder.
Figure 9:
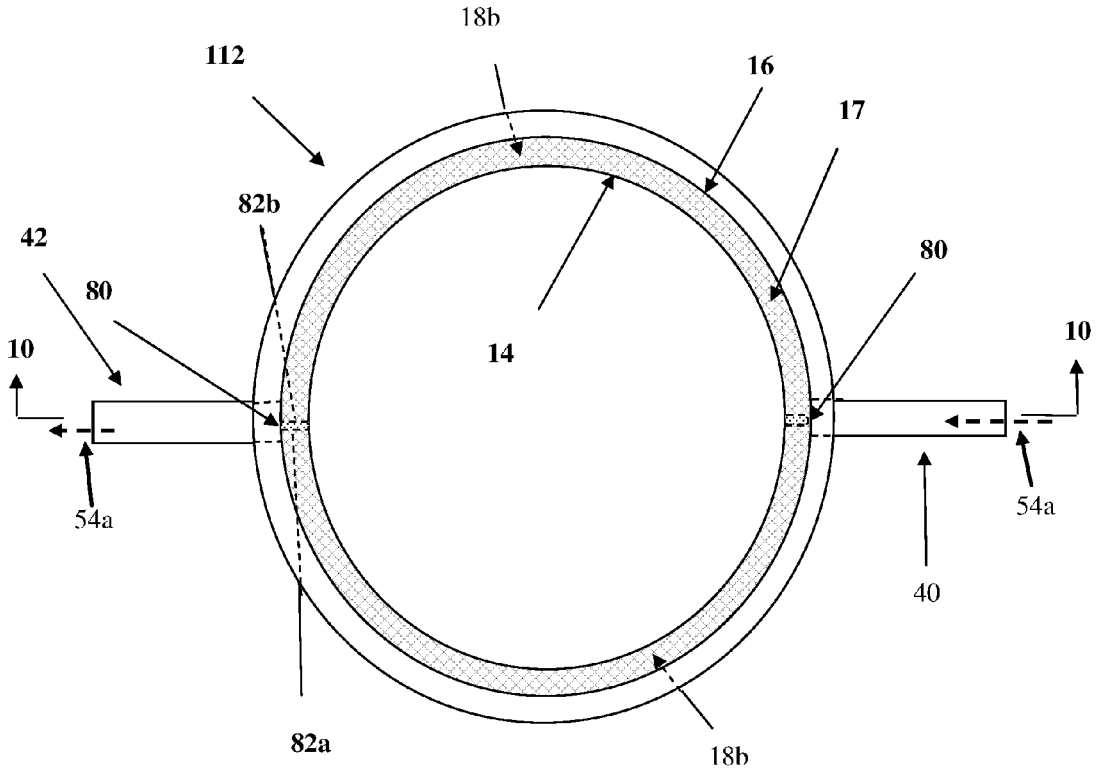
FIG. 9 is a top view of and inlet-outlet distribution guide container holder.
Figure 10:
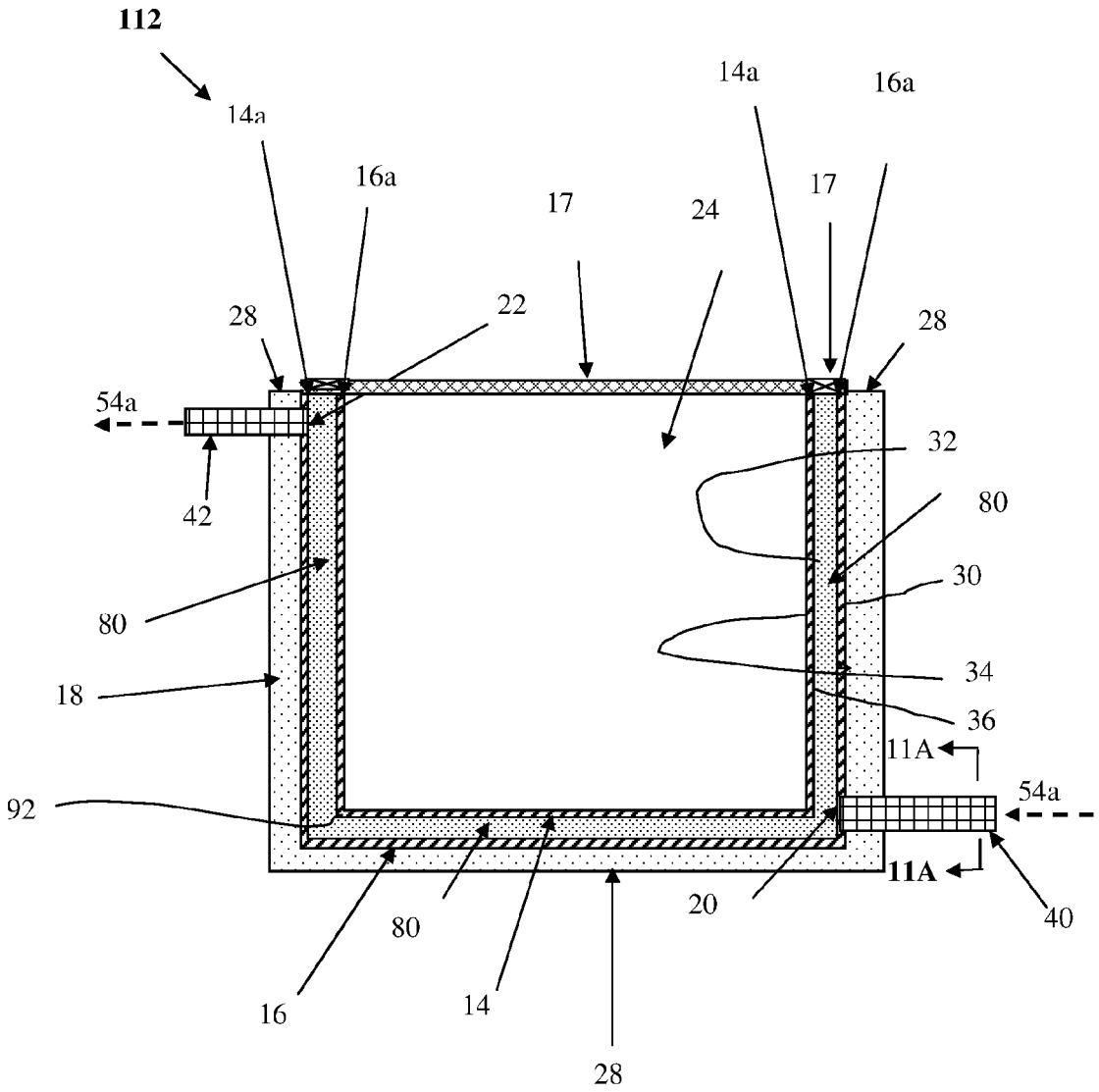
FIG. 10 is sectional view along line 10-10 of FIG. 9.

Referring to FIGS. 8, 9, and 10, FIG. 8 shows a see through (i.e., as if the second wall 16, and the insulation layer 28 are made of transparent materials) prospective view of another embodiment of a container holder, an inlet-outlet distribution guide container holder 112, having all the elements of the guideless container holder 12*c* of FIG. 3 plus one distribution guide (i.e., a first distribution guide 80). The first distribution guide 80 is disposed between the first wall 14 and the second wall 16 of the guideless container holder 12*c*. FIG. 9 shows a top view of the inlet-outlet distribution guide container holder 112. FIG. 10 shows sectional view of FIG. 9. Referring to FIG. 9, the first distribution guide 80 runs from the first wall 14 and to the second wall 16, and referring to FIG. 10, to the first wall edge 14*a* and to the second wall edge 16*a* dividing the chamber 18 into symmetric halves, a one half 18*a* and a second half 18*b* as shown in FIG. 9. The fluid flow 54*a* runs from the inlet connector 40 to the outlet connector 42. Looking to FIG. 10, the first distribution guide 80 is used to more effectively distribute the fluid flow 54*a* along the first wall inner surface 36. Looking again to FIG. 8, the first distribution guide 80 has a guide inner edge 80*a* and a guide outer edge 80*b*. The guide inner edge 80*a* is adjacent to a first wall inner surface 36 of the first wall 14 and the guide outer edge 80*b* is adjacent to the second wall 16. The first distribution guide 80 having a first face 82*a* and a second face 82*b* with the first face 82*a* being generally parallel to the second face 82*b;*

Figure 11A:
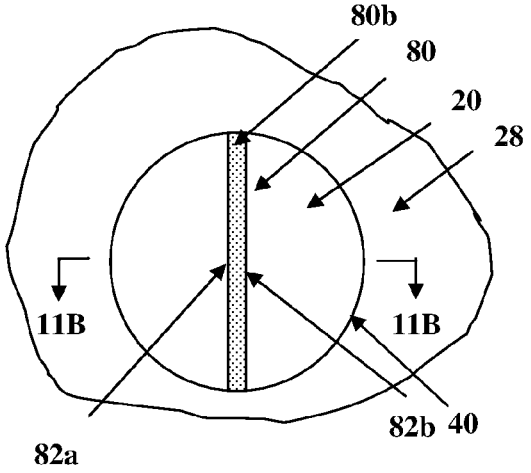
FIG. 11A is a sectional view along line 11A-11A of FIG. 10.

Looking to FIGS. 8, 9, 10, and 11A, the first distribution guide 80 runs from the first wall edge 14*a* and the second wall edge 16*a* dividing the chamber in the symmetric halves, the one half 18*a* and the second half 18*b*, allowing half of the fluid flow 54*a* from the inlet 20 to circulate in one half 18*a* and the remaining flow to circulate in a second half 18*b* of the chamber 18. Referring to FIGS. 10 and 11A, the first distribution guide 80 is further disposed to split flow through the outlet 22. Looking again to FIG. 8, the first distribution guide 80 has a guide inner edge 80*a* and a guide outer edge 80*b*. The guide inner edge 80*a* is adjacent to a first wall inner surface 36 of the first wall 14 and the guide outer edge 80*b* adjacent to the second wall 16. The first distribution guide 80 has a first face 82*a* and a second face 82*b* with the first face 82*a* generally opposite to the second face 82*b*.

Figure 11B:
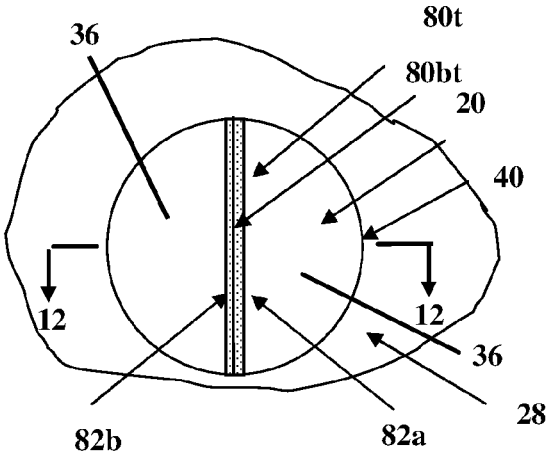
FIG. 11B is a side view of a inlet-outlet triangular distribution guide container holder as viewed through the inlet of FIG. 11A.
Figure 12:
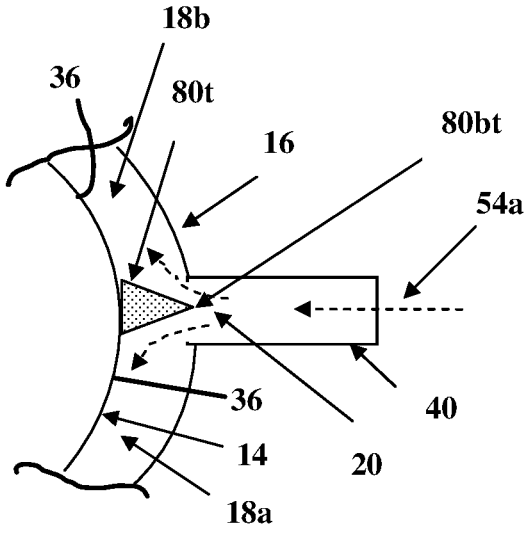
FIG. 12 sectional view along line 12-12 of FIG. 11B.

Looking to FIGS. 11B and 12, yet another embodiment of container holder, an inlet-outlet triangular distribution guide container holder 112T, having all the elements of the inlet-outlet distribution container holder 112, except a second distribution guide 80*t* replaces the first distribution guide 80 of the inlet-outlet triangular distribution guide container holder 112T in FIGS. 8, 9, 10 and 11A. Looking to FIG. 11B, the second distribution guide 80*t* is shown is disposed at the inlet 20 and in the same location as the first distribution guide 80 shown in FIG. 11A and FIG. 8. Looking to FIG. 12, the second distribution guide 80*t*, because of an angled outer edge 80*bt*, may more effectively distribute the fluid flow 54*a* at the inlet 20 to the one half 18*a* and the second half 18*b* of the chamber 18 of FIG. 8.

Figure 13:
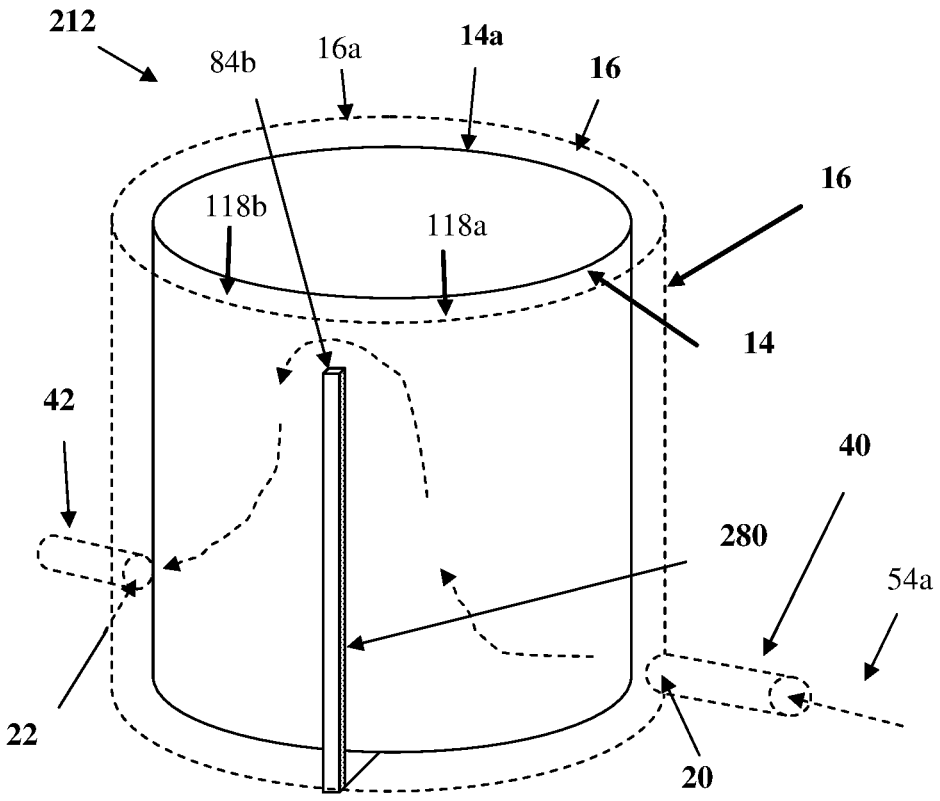
FIG. 13 is a prospective view a partial wall distribution guide container holder.

Looking to FIG. 13, still yet another embodiment of a container holder, a partial wall container holder 212, is shown without the insulation layer 28 of the one embodiment 12 shown in FIG. 3, and with yet another distribution guide, a third distribution guide 280. The third distribution guide 280 has all the elements of the first distribution guide 80 shown in FIG. 8 but has a guide second end 84*b* that is lowered along the first wall 14 providing only a partial wall in the chamber 18. Referring to FIG. 13, the third distribution guide 280 may be disposed generally midway between the inlet 20 and the outlet 22 on the second wall 16 with the third distribution guide 280 disposed so that a guide second end 84*b* is below the second wall edge 16*a* and below the first wall edge 14*a*, and thus below the top cap 17 shown in FIG. 3. The fluid flow 54*a* flows from the inlet 20 circulates through a partial wall one half 118*a* and then flowing over the guide second end 84*b* of the first distribution guide 80 and through a partial wall second half 118*b* down the first wall 14 and then through the outlet 22.

Figure 14:
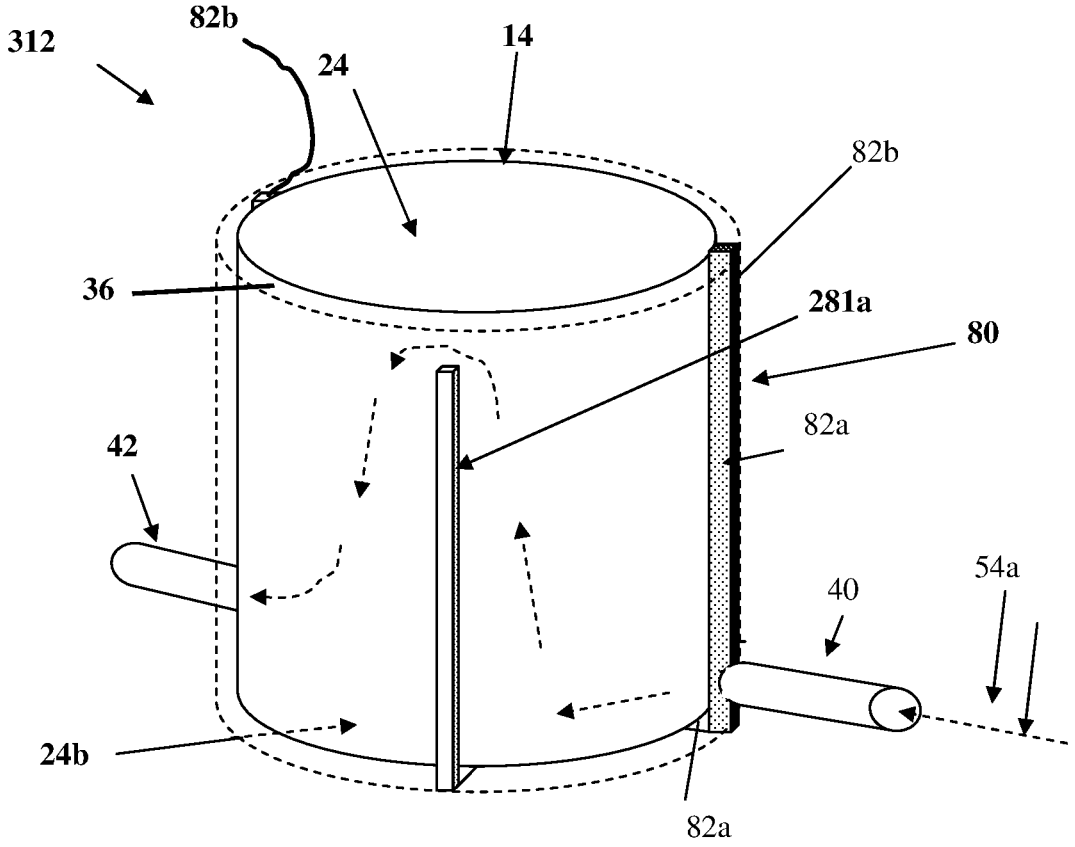
FIG. 14 is prospective of in inner wall of and combined distribution guide container holder.

Looking to FIG. 14, first wall 14 and the second wall 16 of a yet still yet another embodiment of the container holder 12, a combined guide container holder 312 are shown without the insulation layer 28 of the one embodiment of the container holder 12 shown in FIG. 6. The combined guide container holder 312 integrates the first distribution guide 80 and the third distribution guide 280 to provide a combined distribution guide. The first distribution guide 80 is disposed generally perpendicular to the third distribution guide 280 dividing the chamber 18 into four quadrants to effectively distribute the fluid flow 54*a* over the first wall inner surface 36 of the first wall 14. The third distribution guide 280 having a third distribution guide first half 281*a* and an opposite third distribution guide second half (not shown). The third distribution guide first half 281*a* joined to the first face 82*a* of the first distribution guide 80 under the first wall 14. In a similar manner the third distribution guide second half is joined to the second face 82*b*. of the first distribution guide 80.

Figure 15:
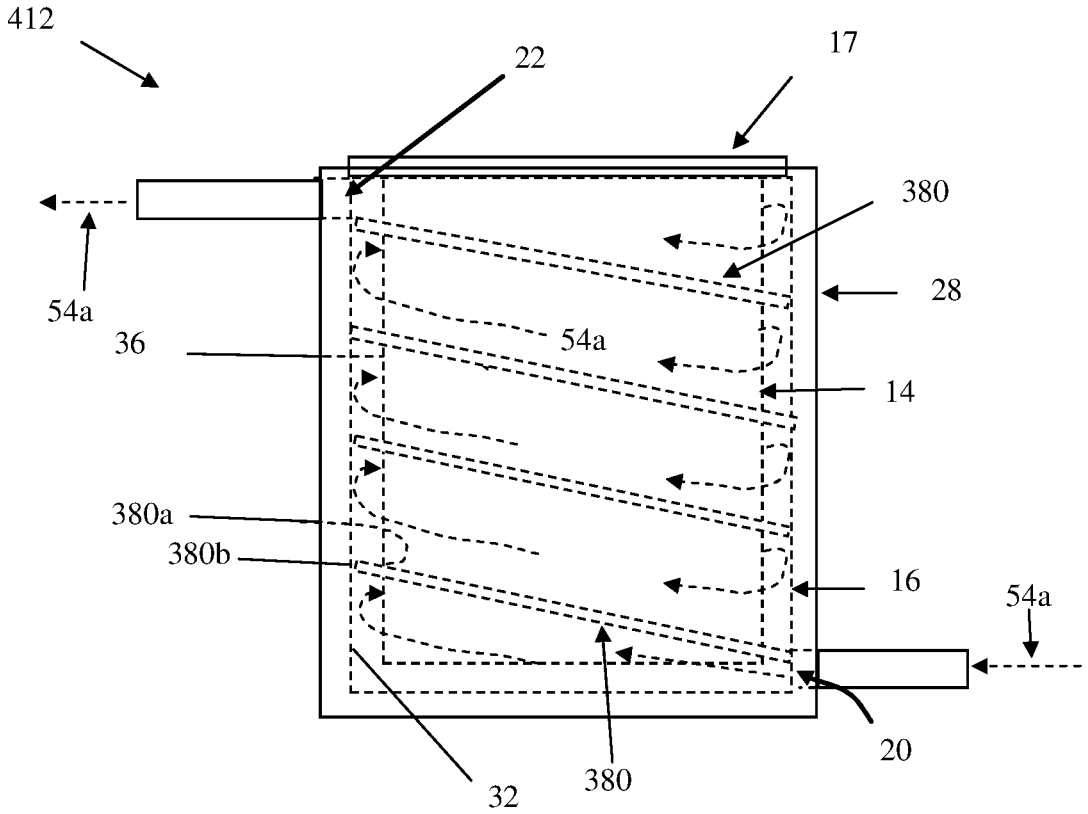
FIG. 15 is elevation view of a spiral distribution guide container holder.
Figure 16:
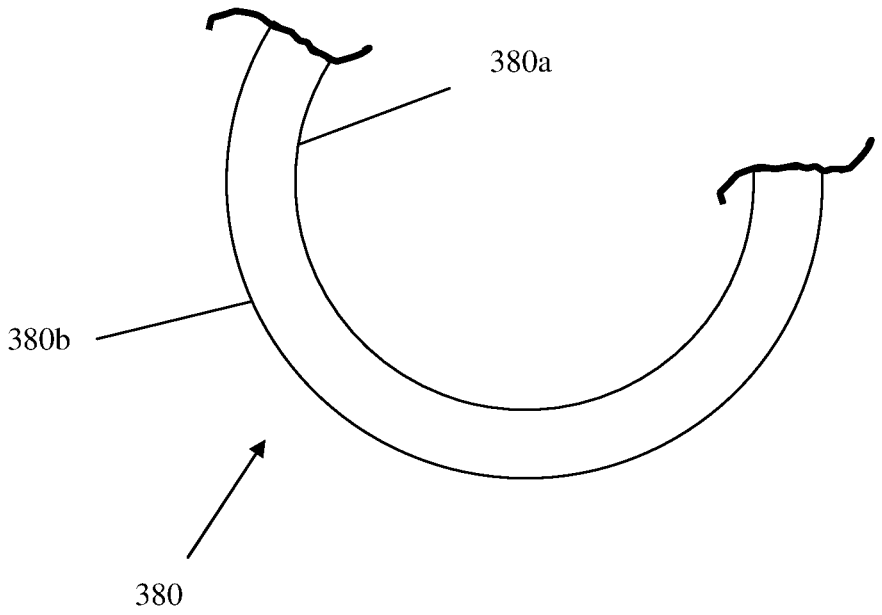
FIG. 16 is a top view of a portion of a spiral distribution guide.

Referring to FIG. 15, a yet still yet another embodiment of a container holder, a spiral distribution guide container holder 412 is shown. The spiral distribution guide container holder 412 has the all the element of the guideless container holder 12*c* of FIGS. 3, 4, 5, and 6 plus a fourth distribution guide, a spiral distribution guide 380. The spiral distribution guide 380 is disposed between the first wall 14 and the second wall 16, a spiral inner edge 380*a* wrapping around the first wall inner surface 36 of the first wall 14 and a spiral outer edge 380*b* adjacent to the second wall inner surface 32. The spiral distribution guide 380 looks like a spiral blade of an auger (not shown) or the exterior threads on a threaded pipe (not shown) with the fluid flow 54*a* flowing around the first wall 14 from the inlet 20 to the outlet 22. Referring to FIG. 16, a top view of a portion of the spiral distribution guide 380 is shown depicting the spiral inner edge 380*a* and the spiral outer edge 380*b*.

Figure 17:
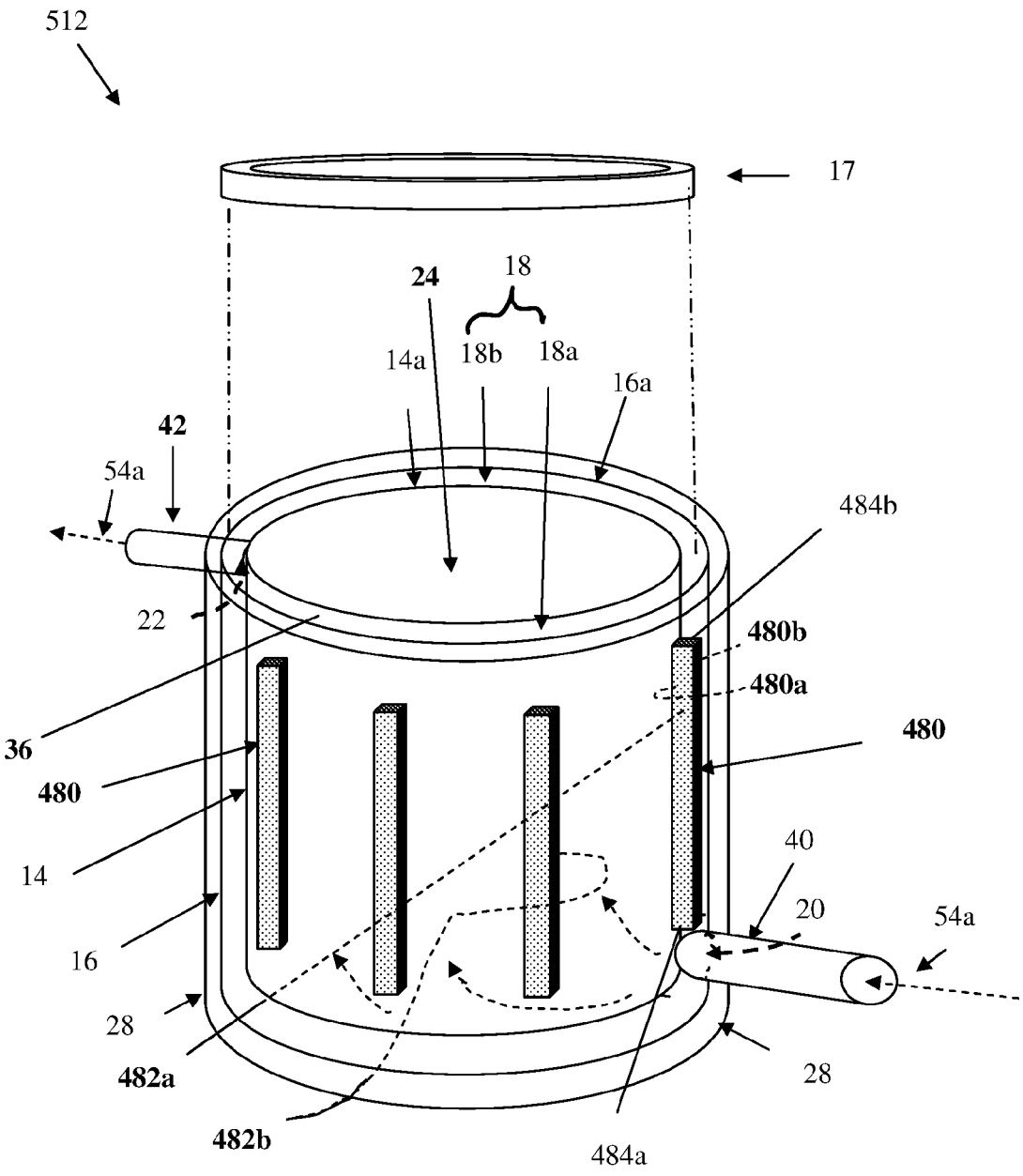
FIG. 17 is a prospective view of a fin distribution guide container holder.
Figure 18:
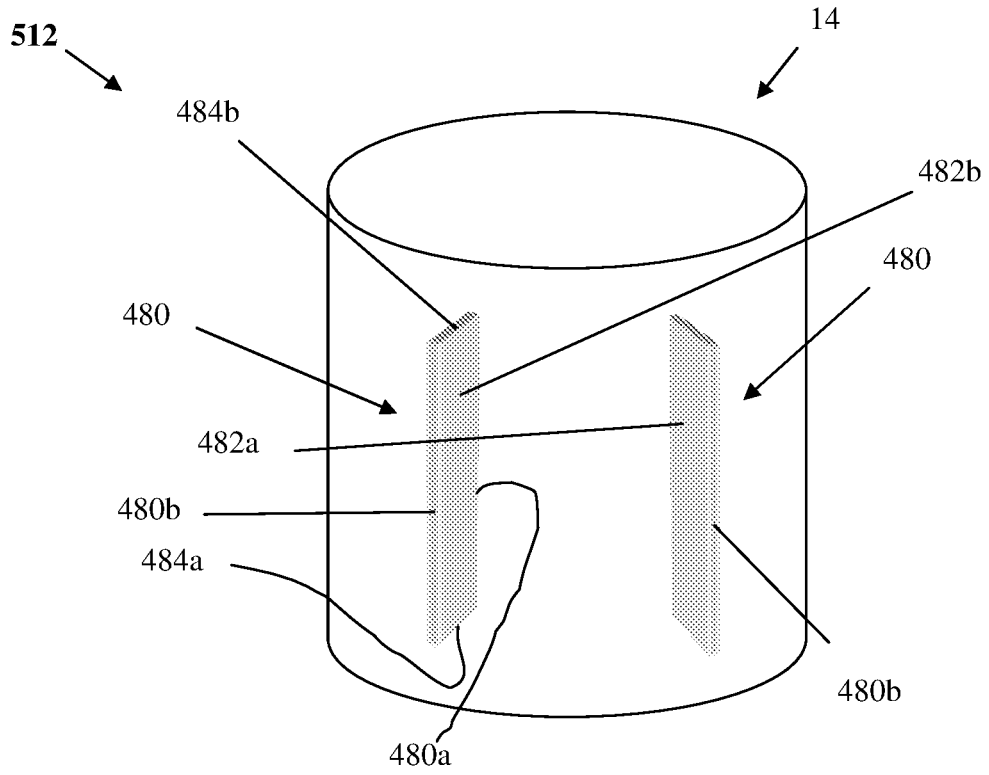
FIG. 18 is a prospective view of a first wall of another fin distribution guide container holder showing fins extended from the first wall.

Referring to FIG. 17, a still yet another embodiment of a container holder 12, a fin distribution guide container holder 512 is presented. The fin distribution guide container holder 512 has the all the elements of the guideless container holder 12*c* of FIGS. 3, 4, 5, and 6 plus one more fin distribution guides 480. Referring to FIG. 18, each of the fin distribution guides 480 has a fin inner edge 480*a*, the a fin outer edge 480*b*, the fin outer edge 480*b* generally opposite the fin inner edge 480*a*; a fin first face 482*a* and a fin second face 482*b* with the fin first face 482*a* generally opposite the fin second face 482*b*; a fin first end 484*a* and a fin second end 484*b*, the fin second end 484*b* located opposite the fin first end 484*a*;

the fin first end 484*a* and the fin second end 484*b* located between the fin inner edge 480*a* and the fin outer edge 480*b*; the fin inner edge 480*a*, the fin outer edge 480*b*, the fin first end 484*a*, and the fin second end 484*b* located between the fin first face 482*a* and the fin second face 482*b*. The fin distribution guide 480 disposed generally between the inlet 20 and the outlet 22. The outlet 22 may be disposed generally above the fin second end 484*b* and the fin first end 484*a* disposed generally above the inlet 20; and in an alternative (not shown), the inlet 20 may be disposed generally above the fin second end 484*b* and the fin first end 484*a* disposed generally above the outlet 22 with the outlet 22 disposed generally opposite and below the inlet 20 on the second wall 16. The fin inner edge 480*a* is disposed adjacent to the first wall inner surface 36. Referring to FIG. 18, the one or more fin distribution guides 480 may be disposed vertically in a radial manner around the first wall 14 with the fin first face 482*a* of each of one or more fin distribution guides 480 opposite the fin second face 482*b* of any other adjacent fin distribution guide 480. Referring again to FIG. 17, the fluid flow 54*a* will flow from the inlet 20 over the fin first face 482*a* and the fin second face 482*b* and out the outlet 22, transferring heat from the first wall 14 to the fluid flow 54*a*.

Referring again to FIG. 3, when constructing the container holder 12, such as the guideless container holder 12*c*, the first wall 14 may be made of a materials having a low thermal resistance, such as a copper or a stainless steel, thus providing effective heat transfer between the container 26 and the first wall 14 and then to the fluid flow 54*a*. The second wall 16 may be made of a material with a high thermal resistance, such as a plastic. Materials with a high thermal resistance minimize heat transferring from the environment to second wall 16 and then to the fluid flow 54*a* and/or to any of the distribution guides (i.e., the first distribution guide 80 of FIG. 8, the second distribution guide 80*t* of FIG. 11B, the third distribution guide 280 of FIG. 13, the spiral distribution guide 380 of FIG. 16, or fin distribution guide 480 of FIG. 18), and then to the first wall 14 and then to the container 26 in the pocket 24. The first wall 14 may be spaced from the second wall 16 according to the specific application to achieve the desired heat transfer. Generally, the first wall 14 may be 0.25 to 1.00 inch from the second wall 16. The first wall 14 and the second wall 16 may have material thicknesses similar to those of the walls of vacuum thermos bottles commonly available in the marketplace. The distribution guides, such as the first distribution 80, my have a guide material thickness between 0.001 to 0.1 inches as measured from the first face 82*a* to the second face 82*b* of the first distribution 80, and may be made of the same materials as the first wall. The insulation layer, where required, may generally have a material thickness from 0.1 to 0.5 inches and be made of foam, cork, or other commercially available insulator. The reservoir adapter 13*c* may be a rectangular box or other structure that is a sealed structure when the supply in-port 70*a*, the supply out-port 70*b*, and the return in-port 71*a* are connected for implementation of the device. The supply in-port 70*a* is sized to screw to the threads (not shown) of the reservoir drain outlet 60*a*, such as an ice chest drain outlet 60*a*, and where the reservoir drain outlet 60*a* is not threaded, a pressure fit may be acceptable. The supply out-port 70*b* may be sized and configured to fit the circulator in-port 50*a* where the circulator in-port 50*a* is connected directly to the reservoir adapter 13*c*. Otherwise the supply out-port 70*b* is sized and configured to fit the supply line 44. The return in-port 71*a* of the reservoir adapter 13*c* may generally be sized and configured for the return line 48 providing a water type seal around the return line 48. The long line 74 may be of a long line inner diameter equal to the return line inner diameter of the return line 48 and have long line outer diameter generally not greater than half a drain outlet inner diameter of the reservoir drain outlet 60*a* enabling the long line 74 to pass through the reservoir drain outlet 60*a* when the long line 74 is placed through the reservoir drain outlet 60*a*. The circulator 13*a* may be a commercially available pump providing the required fluid flow 54*a* based on the environment and the application to achieve a desired temperature of the container 26. This includes electric pumps and hand pumps including siphoned pumps, such as a First Auto Model 720826413114.

Although the present invention has been described in considerable detail with reference to preferred versions thereof, other versions are possible. Therefore, the spirit and scope of the appended claims should not be limited to the description of the preferred versions contained herein. Various deviations and modification may be made within the spirit and scope of this invention without departing from the main theme thereof.

We claim:

1. A beverage cooler assembly comprising: one or more container holders; the one or more container holders each having a first wall and a second wall with a chamber there between the first wall and the second wall; the second wall having an inlet and an outlet; the second wall enclosing the first wall; and the first wall disposed to form a pocket having a top opening; the pocket sized to hold a container; the second wall having a second wall outer surface and a second wall inner surface; the first wall having a first wall outer surface and a first wall inner surface; and a first wall edge and a second wall edge capped by a top cap; the beverage cooler assembly further comprising a reservoir adapter; the reservoir adapter configured to fit to a drain outlet of a reservoir; the beverage cooler assembly further comprising a circulator; and the circulator disposed integrated with the one or more container holders and the reservoir adapter; the each of the one or more container holders further comprising a partial wall distribution guide; the partial wall distribution guide disposed between the first wall and the second wall; the partial wall distribution guide having a guide inner edge, a guide outer edge and a guide second end; the guide inner edge adjacent to the first wall inner surface of the first wall and the guide outer edge adjacent to the second wall inner surface of the second wall; the guide second end below the second wall edge of the second wall and also below the first wall edge of the first wall; and the inlet disposed directly opposite the outlet on the second wall; and the partial wall distribution guide disposed midway between the inlet and the outlet.

2. The beverage cooler assembly in claim 1 wherein the circulator is pump.

3. The beverage cooler assembly in claim 1 wherein the circulator is a siphon pump.

4. The beverage cooler assembly in claim 1 wherein the one or more container holders each further comprises an insulation layer; and the insulation layer adjacent to and covering the second wall outer surface of the second wall.

5. The beverage cooler assembly in claim 1 wherein the inlet connects to an inlet connector and the outlet connects to an outlet connector; the inlet connector extending from the second wall outer surface of the second wall; and the outlet connector extending from the second wall outer surface of the second wall.

6. The beverage cooler assembly in claim 5 further comprising a first container holder of the one or more container holders and a second container holder.

7. The beverage cooler assembly in claim 6 further comprising a supply line a transfer line, and a return line; the supply line having a first end and a second end; the transfer line having first trans opening and a second trans opening; and the return line having a first opening and a second opening; the second end of the supply line connected to the inlet and the first opening of the return line connected to the outlet of the second container holder; the first trans opening connected to the outlet of the first container holder; and the second trans opening connected to the inlet of the second container holder; and the circulator is connected to the first end of the supply line.

8. The beverage cooler assembly in claim 7 wherein the circulator circulates a fluid from the reservoir through the supply line, through the chamber of the first container holder, through the transfer line, through the chamber of the second container holder, and through the return line to the reservoir.

9. The beverage cooler assembly in claim 8 further comprising a long line the long line having return end and a reservoir end, the reservoir end disposed in the reservoir.

10. The beverage cooler assembly in claim 9 wherein the reservoir adapter has a supply in-port, a supply out-port, a return in-port; the return in-port connecting to the return end of the long line with the second opening of the return line; the long line running into the reservoir; the supply in-port connected to a reservoir drain outlet; the supply out-port connected to a circulator in-port; and a circulator out-port connected to the first end of the supply line.

11. The beverage cooler assembly in claim 10 wherein the long line has a non-perforated portion and a perforated portion; the perforated portion; and the perforated portion made of a thermally conductive material.

12. The beverage cooler assembly in claim 11 wherein the long line has an end cap; the end cap capping the reservoir end of the perforated portion; an initial end of the perforated portion connected to an outgoing end of the non-perforated portion; the end cap having at least one end port and the perforated portion having at least one line port; and the long line configured to run through the reservoir drain outlet into the reservoir.

13. The beverage cooler assembly of claim 12 wherein the second wall is made of a material having a high thermal resistance and the first wall is made of low thermal resistance material.

14. A beverage cooler assembly comprising: one or more container holders; the one or more container holders each having a first wall and a second wall with a chamber there between the first wall and the second wall; the second wall having an inlet and an outlet; the second wall enclosing the first wall; and the first wall disposed to form a pocket having a top opening; the pocket sized to hold a container; the second wall having a second wall outer surface and a second wall inner surface; the first wall having a first wall outer surface and a first wall inner surface; and a first wall edge and a second wall edge capped by a top cap; the beverage cooler assembly further comprising a reservoir adapter; the reservoir adapter configured to fit to a drain outlet of a reservoir; the beverage cooler assembly further comprising a circulator; and the circulator disposed integrated with the one or more container holders and the reservoir adapter; the beverage cooler assembly further comprising a first distribution guide; the first distribution guide disposed between the first wall and the second wall; the first distribution guide having a guide inner edge and a guide outer edge; the guide inner edge adjacent to the first wall inner surface of the first wall and the guide outer edge adjacent to the second wall inner surface of the second wall; the guide outer edge disposed to split a fluid flow flowing through the inlet; and the guide outer edge disposed to split the fluid flow flowing through the outlet; and the first distribution guide disposed to divide the chamber into a one half and a second half.

15. A beverage cooler assembly comprising: one or more container holders; the one or more container holders each having a first wall and a second wall with a chamber there between the first wall and the second wall; the second wall having an inlet and an outlet; the second wall enclosing the first wall; and the first wall disposed to form a pocket having a top opening; the pocket sized to hold a container; the second wall having a second wall outer surface and a second wall inner surface; the first wall having a first wall outer surface and a first wall inner surface; and a first wall edge and a second wall edge capped by a top cap; the beverage cooler assembly further comprising a reservoir adapter; the reservoir adapter configured to fit to a drain outlet of a reservoir; the beverage cooler assembly further comprising a circulator; and the circulator disposed integrated with the one or more container holders and the reservoir adapter; the each of the one or more container holders further comprising a first distribution guide and a third distribution guide; the first distribution guide is disposed substantially perpendicular to the third distribution guide dividing the chamber into four quadrants; the first distribution guide disposed between the first wall and the second wall; the first distribution guide having a guide inner edge and a guide outer edge; the guide inner edge adjacent to the first wall inner surface of the first wall and the guide outer edge adjacent to the second wall inner surface of the second wall; the guide outer edge disposed to split a fluid flow flowing through the inlet; and the guide outer edge disposed to split the fluid flow flowing through the outlet; the third distribution guide having a third distribution guide first half and a third distribution guide second half; and the third distribution guide first half joined to a first face of the first distribution guide and the third distribution guide second half joined to a second face of the first distribution guide.

16. A beverage cooler assembly comprising: one or more container holders; the one or more container holders each having a first wall and a second wall with a chamber there between the first wall and the second wall; the second wall having an inlet and an outlet; the second wall enclosing the first wall; and the first wall disposed to form a pocket having a top opening; the pocket sized to hold a container; the second wall having a second wall outer surface and a second wall inner surface; the first wall having a first wall outer surface and a first wall inner surface; and a first wall edge and a second wall edge capped by a top cap; the beverage cooler assembly further comprising a reservoir adapter; the reservoir adapter configured to fit to a drain outlet of a reservoir; the beverage cooler assembly further comprising a circulator; and the circulator disposed integrated with the one or more container holders and the reservoir adapter; the each of the one or more container holders further comprising a spiral distribution guide; the spiral distribution guide spiraling around the first wall; the spiral distribution guide having a spiral inner edge and a spiral outer edge; and the spiral inner edge adjacent to the first wall inner surface of the first wall and the spiral outer edge adjacent to the second wall inner surface of the second wall.

17. A beverage cooler assembly comprising: one or more container holders; the one or more container holders each having a first wall and a second wall with a chamber there between the first wall and the second wall; the second wall having an inlet and an outlet; the second wall enclosing the first wall; and the first wall disposed to form a pocket having a top opening; the pocket sized to hold a container; the second wall having a second wall outer surface and a second wall inner surface; the first wall having a first wall outer surface and a first wall inner surface; and a first wall edge and a second wall edge capped by a top cap; the beverage cooler assembly further comprising a reservoir adapter; the reservoir adapter configured to fit to a drain outlet of a reservoir; the beverage cooler assembly further comprising a circulator; and the circulator disposed integrated with the one or more container holders and the reservoir adapter; the each of the one or more container holders further comprising one or more fin distribution guides; the one or more fin distribution guides each having a fin first end and a fin second end; the fin second end located opposite the fin first end; the fin first end and the fin second end located between a fin inner edge and a fin outer edge; the fin inner edge located opposite the fin outer edge; the fin inner edge disposed vertically and adjacent to the first wall inner surface of the first wall, the fin first end disposed between the inlet and the outlet; the fin second end disposed between the inlet and the outlet; and the outlet disposed on the second wall substantially opposite and above the inlet.

18. A beverage cooler assembly comprising: one or more container holders; the one or more container holders each having a first wall and a second wall with a chamber there between the first wall and the second wall; the second wall having an inlet and an outlet; the second wall enclosing the first wall; and the first wall disposed to form a pocket having a top opening; the pocket sized to hold a container; the second wall having a second wall outer surface and a second wall inner surface; the first wall having a first wall outer surface and a first wall inner surface; and a first wall edge and a second wall edge capped by a top cap; the beverage cooler assembly further comprising a reservoir adapter; the reservoir adapter configured to fit to a drain outlet of a reservoir; the beverage cooler assembly further comprising a circulator; and the circulator disposed integrated with the one or more container holders and the reservoir adapter; the beverage cooler assembly wherein the inlet connects to an inlet connector and the outlet connects to an outlet connector; the inlet connector extending from the second wall outer surface of the second wall; and the outlet connector extending from the second wall outer surface of the second wall; the beverage cooler assembly further comprising a first container holder of the one or more container holders and a second container holder; the beverage cooler assembly further comprising a supply line a transfer line, and a return line; the supply line having a first end and a second end; the transfer line having first trans opening and a second trans opening; and the return line having a first opening and a second opening; the second end of the supply line connected to the inlet and the first opening of the return line connected to the outlet of the second container holder; the first trans opening connected to the outlet of the first container holder; and the second trans opening connected to the inlet of the second container holder; and the circulator is connected to the first end of the supply line; the beverage cooler assembly wherein the circulator circulates a fluid from the reservoir through the supply line, through the chamber of the first container holder, through the transfer line, through the chamber of the second container holder, and through the return line to the reservoir; the beverage cooler assembly further comprising a long line the long line having return end and a reservoir end, the reservoir end disposed in the reservoir; the beverage cooler assembly wherein the reservoir adapter has a supply in-port, a supply out-port, a return in-port; the return in-port connecting to the return end of the long line with the second opening of the return line; the long line running into the reservoir; the supply in-port connected to a reservoir drain outlet; the supply out-port connected to a circulator in-port; and a circulator out-port connected to the first end of the supply line.

19. The beverage cooler assembly in claim 18 wherein the long line has a non-perforated portion and a perforated portion; the perforated portion; and the perforated portion made of a thermally conductive material.

20. The beverage cooler assembly in claim 19 wherein the long line has an end cap; the end cap capping the reservoir end of the perforated portion; an initial end of the perforated portion connected to an outgoing end of the non-perforated portion; the end cap having at least one end port and the perforated portion having at least one line port; and the long line configured to run through the reservoir drain outlet into the reservoir.

21. The beverage cooler assembly of claim 20 wherein the second wall is made of a material having a high thermal resistance and the first wall is made of low thermal resistance material.

* * * * *